US008985070B2

(12) United States Patent
Tateno et al.

(10) Patent No.: US 8,985,070 B2
(45) Date of Patent: Mar. 24, 2015

(54) VARIABLE COMPRESSION RATIO V-TYPE INTERNAL COMBUSTION ENGINE

(75) Inventors: Manabu Tateno, Shizuoka (JP); Eiichi Kamiyama, Mishima (JP); Naoto Hisaminato, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/510,437

(22) PCT Filed: Nov. 17, 2009

(86) PCT No.: PCT/JP2009/069753

§ 371 (c)(1),
(2), (4) Date: May 17, 2012

(87) PCT Pub. No.: WO2011/061861

PCT Pub. Date: May 26, 2011

(65) Prior Publication Data

US 2012/0260890 A1 Oct. 18, 2012

(51) Int. Cl.

| | |
|---|---|
| ***F02B 75/04*** | (2006.01) |
| ***F02B 75/22*** | (2006.01) |
| *F02D 15/02* | (2006.01) |

(52) U.S. Cl.

CPC ..... *F02B 75/22* (2013.01); *F02B 75/041* (2013.01); *F02D 15/02* (2013.01); *F02B 75/045* (2013.01); *F02B 75/048* (2013.01)

USPC ..... 123/48 B

(58) Field of Classification Search

CPC .... F02B 75/048; F02B 75/045; F02B 75/044; F02B 75/04; F02D 15/02

USPC ..... 123/48 B

See application file for complete search history.

(56) References Cited

U.S. PATENT DOCUMENTS

| | | | | |
|---|---|---|---|---|
| 7,036,468 | B2 * | 5/2006 | Kamiyama | 123/78 R |
| 7,917,279 | B2 * | 3/2011 | Akihisa et al. | 701/103 |
| 2008/0178857 | A1 * | 7/2008 | Kamiyama | 123/78 C |
| 2009/0241910 | A1 * | 10/2009 | Shin et al. | 123/48 B |
| 2011/0048383 | A1 * | 3/2011 | Pattakos et al. | 123/48 B |

FOREIGN PATENT DOCUMENTS

| | | | |
|---|---|---|---|
| JP | 2002-250241 | A | 9/2002 |
| JP | 2004-324464 | A | 11/2004 |
| JP | 2005-113743 | A | 4/2005 |
| JP | 2008-175135 | A | 7/2008 |
| JP | 2009-052455 | A | 3/2009 |
| JP | 2009-097449 | A | 5/2009 |

* cited by examiner

*Primary Examiner* — Lindsay Low
*Assistant Examiner* — Charles Brauch
(74) *Attorney, Agent, or Firm* — Gifford, Krass, Sprinkle, Anderson & Citkowski, P.C.

(57) ABSTRACT

The present variable compression ratio V-type internal combustion engine is a variable compression ratio V-type internal combustion engine which joins cylinder blocks of two cylinder groups and makes the joined cylinder block move relatively to a crankcase, wherein the engine is provided with a first relative movement mechanism which is fastened to a first cylinder group side of the joined cylinder block through a plurality of supports and a second relative movement mechanism which is fastened to a second cylinder group side of the joined cylinder block through a plurality of supports. The number of the supports in each of the first relative movement mechanism and the second relative movement mechanism is made at least a number greater by exactly one than the number of cylinders of the first cylinder group and the second cylinder group, respectively.

4 Claims, 6 Drawing Sheets

VARIABLE COMPRESSION RATIO V-TYPE INTERNAL COMBUSTION ENGINE

TECHNICAL FIELD

The present invention relates to a variable compression ratio V-type internal combustion engine.

BACKGROUND ART

In general, the lower the engine load, the worse the heat efficiency, so at the time of engine low load operation, the mechanical compression ratio ((top dead center cylinder volume stroke volume)/top dead center cylinder volume) is preferably raised to raise the expansion ratio and thereby improve the heat efficiency. For this, it has been known to make the cylinder block and crankcase move relative to each other to change the distance between the cylinder block and the crankshaft and thereby make the mechanical compression ratio variable.

In a V-type internal combustion engine, it has been proposed to make the cylinder block parts of the two cylinder groups move relatively to the crankcase separately along the cylinder centerlines of the cylinder groups, but it is difficult to make different cylinder block parts move relatively to the crankcase by a single link mechanism (or cam mechanism). A pair of link mechanisms (or cam mechanisms) becomes necessary for each cylinder block part, so overall two pairs of link mechanisms end up becoming necessary.

To reduce the number of link mechanisms, a variable compression ratio V-type internal combustion engine has been proposed which joins the cylinder blocks of two cylinder groups and makes the joined cylinder block move relatively to the crankcase by a pair of relative movement mechanisms (for example, a pair of link mechanisms) (refer to Japanese Patent Unexamined Publication (A) No. 2005-113743, Japanese Patent Unexamined Publication (A) No. 2002-250241, Japanese Patent Unexamined Publication (A) No. 2008-175135, and Japanese Patent Unexamined Publication (A) No. 2009-097449).

The relative movement mechanism at one cylinder group side and the relative movement mechanism at the other cylinder group side respectively have pluralities of supports for fastening to the cylinder block and pluralities of supports for fastening to the crankcase.

In general, the plurality of supports at the cylinder block side in the relative movement mechanism at one cylinder group side and the plurality of supports at the cylinder block side at the relative movement mechanism at the other cylinder group side are arranged symmetrically about a median plane between the two cylinder groups.

DISCLOSURE OF THE INVENTION

Incidently, in the above-mentioned variable compression ratio V-type internal combustion engine, the cylinder block and the crankcase are coupled by just one pair of relative movement mechanisms. The force which tries to push up the cylinder block in the cylinder axial line direction at the time of firing at each cylinder acts on the pair of relative movement mechanisms.

If the supports of the cylinder block sides of the pair of relative movement mechanism are arranged symmetrically as explained above, the force which is generated at the time of firing at each cylinder will act mainly on one or two supports thereby making it necessary to make the supports thicker or otherwise in order to increase the strength of the supports.

Therefore, an object of the present invention is to provide a variable compression ratio V-type internal combustion engine which joins the cylinder blocks of two cylinder groups and makes the joined block move relatively to the crankcase wherein it is not necessary to increase the strength of the plurality of supports at the cylinder block sides of the pair of relative movement mechanisms that much.

A variable compression ratio V-type internal combustion engine as set forth in claim 1 of the present invention is provided, characterized in that the variable compression ratio V-type internal combustion engine joins cylinder blocks of two cylinder groups and makes the joined cylinder block move relatively to a crankcase, and is provided with a first relative movement mechanism which is fastened to a first cylinder group side of the joined cylinder block through a plurality of supports and a second relative movement mechanism which is fastened to a second cylinder group side of the joined cylinder block through a plurality of supports, the number of the supports of the first relative movement mechanism is made at least a number greater by exactly "1" than the number of cylinders of the first cylinder group so that one of the supports of the first relative movement mechanism is positioned at the two sides of the center axial lines of the cylinders in the first cylinder group when viewing the first cylinder group side by the side view, the number of the supports of the second relative movement mechanism is made at least a number greater by exactly "1" than the number of cylinders of the second cylinder group so that one of the supports of the second relative movement mechanism is positioned at the two sides of the center axial lines of the cylinders in the second cylinder group when viewing the second cylinder group side by the side view, and, due to an offset between the cylinders of the first cylinder group and the cylinders of the second cylinder group in the crankshaft direction, one of the supports of the first relative movement mechanism is positioned on the center axial line of each cylinder in the second cylinder group when viewing the first cylinder group side by the side view and one of the supports of the second relative movement mechanism is positioned on the center axial line of each cylinder in the first cylinder group when viewing the second cylinder group side by the side view.

A variable compression ratio V-type internal combustion engine as set forth in claim 2 of the present invention is provided as the variable compression ratio V-type internal combustion engine as set forth in claim 1 characterized in that the supports of the first relative movement mechanism are comprised of first supports which are positioned between center axial lines of two cylinders adjoining each other in the first cylinder group when viewing the first cylinder group side by the side view and second supports which are not positioned between center axial lines of two cylinders adjoining each other in the first cylinder group when viewing the first cylinder group side by the side view, a thickness of the first supports is two times a thickness of the second supports, the supports of the second relative movement mechanism are comprised of third supports which are positioned between center axial lines of two cylinders adjoining each other in the second cylinder group when viewing the second cylinder group side by the side view and fourth supports which are not positioned between center axial lines of two cylinders adjoining each other in the second cylinder group when viewing the second cylinder group side by the side view, and a thickness of the third supports is two times a thickness of the fourth supports.

A variable compression ratio V-type internal combustion engine as set forth in claim 3 of the present invention is provided as the variable compression ratio V-type internal combustion engine as set forth in claim 1 or 2 characterized in that the first relative movement mechanism and the second relative movement mechanism are made independently controllable, a first relative movement distance in a front view engine centerline direction which passes through a center of a crankshaft which is caused by the first relative movement mechanism at the first cylinder group side of the joined cylinder block and a second relative movement distance in the engine centerline direction which is caused by the second relative movement mechanism at the second cylinder group side of the joined cylinder block can be made different, the first relative movement mechanism changes the first relative movement distance when none of the cylinders of the first cylinder group is in an expansion stroke, and the second relative movement mechanism changes the second relative movement distance when none of the cylinders of the second cylinder group is in an expansion stroke.

According to the variable compression ratio V-type internal combustion engine as set forth in claim 1 of the present invention, the number of the supports to fasten the first relative movement mechanism to the first cylinder group side of the joined cylinder block is made at least a number greater by exactly "1" than the number of cylinders of the first cylinder group so that one of the supports of the first relative movement mechanism is positioned at the two sides of the center axial lines of the cylinders in the first cylinder group when viewing the first cylinder group side by the side view, the number of the supports to fasten the second relative movement mechanism to the second cylinder group side of the joined cylinder block is made at least a number greater by exactly "1" than the number of cylinders of the second cylinder group so that one of the supports of the second relative movement mechanism is positioned at the two sides of the center axial lines of the cylinders in the second cylinder group when viewing the second cylinder group side by the side view, and, due to an offset between the cylinders of the first cylinder group and the cylinders of the second cylinder group in the crankshaft direction, one of the supports of the first relative movement mechanism is positioned on the center axial line of each cylinder in the second cylinder group when viewing the first cylinder group side by the side view and one of the supports of the second relative movement mechanism is positioned on the center axial line of each cylinder in the first cylinder group when viewing the second cylinder group side by the side view. Due to this, the force which tries to push up the cylinder block in the cylinder axial line direction at the time of firing of each cylinder acts on the two supports adjoining the firing cylinder when viewing the cylinder group side corresponding to the firing cylinder by the side view and the one support which is positioned on the center axial line of the firing cylinder when viewing the other cylinder group side by the side view, so it is not necessary to increase the strength of the supports of the first relative movement mechanism and second relative movement mechanism that much compared with the case where the force acts on mainly one or two supports.

According to the variable compression ratio V-type internal combustion engine as set forth in claim 2 of the present invention, in the variable compression ratio V-type internal combustion engine as set forth in claim 1, the supports of the first relative movement mechanism are comprised of first supports which are positioned between center axial lines of two cylinders adjoining each other in the first cylinder group when viewing the first cylinder group side by the side view and second supports which are not positioned between center axial lines of two cylinders adjoining each other in the first cylinder group when viewing the first cylinder group side by the side view, the first supports are close in common to two cylinders adjoining each other, so the force at the time of firing of the two cylinders acts on them and therefore the farce at the time of firing acts on them a number of times two times greater than the second supports which are close to just one cylinder, so a thickness of the first supports is made two times a thickness of the second supports to make the strength two times as well, further the supports of the second relative movement mechanism are comprised of third supports which are positioned between center axial lines of two cylinders adjoining each other in the second cylinder group when viewing the second cylinder group side by the side view and fourth supports which are not positioned between center axial lines of two cylinders adjoining each other in the second cylinder group when viewing the second cylinder group side by the side view, the third supports are close in common to two cylinders adjoining each other, so the force at the time of firing of the two cylinders act on them and therefore the force at the time of firing act on them a number of times two times greater than the fourth supports which are close to just one cylinder, so a thickness of the third supports is made two times a thickness of the fourth supports to make the strength two times as well.

According to the variable compression ratio V-type internal combustion engine as set forth in claim 3 of the present invention, in the variable compression ratio V-type internal combustion engine as set forth in claim 1 or 2, the first relative movement mechanism and the second relative movement mechanism are made independently controllable, a first relative movement distance in a front view engine centerline direction which passes through a center of a crankshaft which is caused by the first relative movement mechanism at the first cylinder group side of the joined cylinder block and a second relative movement distance in the engine centerline direction which is caused by the second relative movement mechanism at the second cylinder group side of the joined cylinder block can be made different, when none of the cylinders of the first cylinder group is in an expansion stroke, one of the cylinders of the second cylinder group is in the expansion stroke and the force of that firing cylinder does not act that much on the first relative movement mechanism where the moment length becomes longer compared with the second relative movement mechanism, so the first relative movement mechanism can easily change the first relative movement distance, while when none of the cylinders of the second cylinder group is in an expansion stroke, one of the cylinders of the first cylinder group is in the expansion stroke and the force of that firing cylinder does not act that much on the second relative movement mechanism where the moment length becomes longer compared with the first relative movement mechanism, so the second relative movement mechanism can easily change the second relative movement distance.

DESCRIPTION OF EMBODIMENTS

Figure 1:
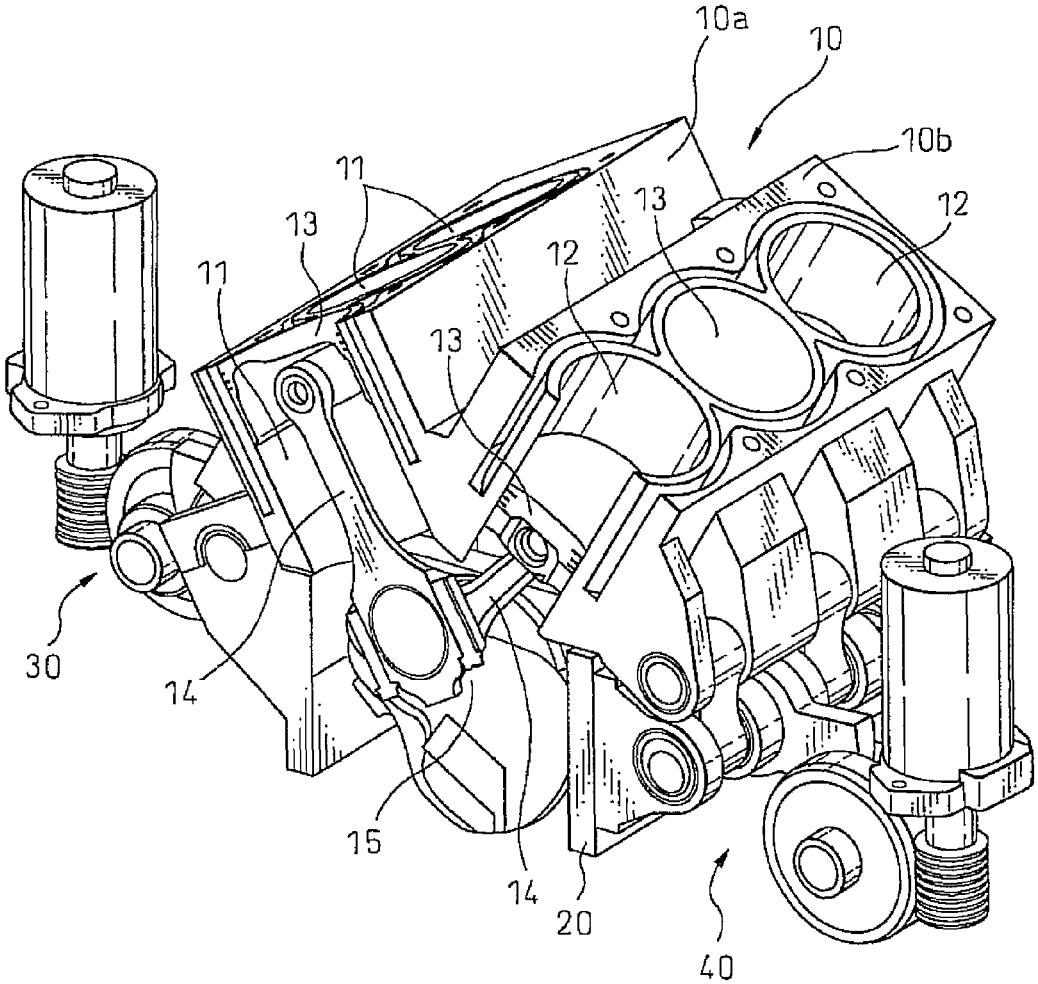
FIG. 1 is a perspective view showing part of a variable compression ratio V-type internal combustion engine according to the present invention.

FIG. 1 is a perspective view showing part of a variable compression ratio V-type internal combustion engine according to the present invention. In FIG. 1, 10 indicates a cylinder block, 20 a crankcase, 30 a first relative movement mechanism of a first cylinder group side, and 40 a second relative movement mechanism of a second cylinder group side. The cylinder block 10 is comprised of a first cylinder group side part 10*a* and a second cylinder group side part 10*b* formed integrally. Inside first cylinder group side cylinder bores 11 and second cylinder group side cylinder bores 12, pistons 13 are arranged. The pistons 13 are connected by a connecting rod 14 to a crank shaft 15.

This V-type internal combustion engine is a spark ignition type. The first cylinder group side part 10*a* and the second cylinder group side part 10*b* of the cylinder block 10 are mounted with cylinder heads (not shown). At the cylinder heads, spark plugs are provided for the cylinder bores. At each cylinder head, intake ports and exhaust ports are formed. Each intake port is communicated through an intake valve to a corresponding cylinder bore, while each exhaust port is communicated through an exhaust valve to a corresponding cylinder bore 11. For each cylinder head, an intake manifold and exhaust manifold are connected. The intake manifolds open to the atmosphere either independently of each other or by merging via an air cleaner, while the exhaust manifolds are also open to the atmosphere either independently of each other or by merging via a catalyst device. Further, the V-type internal combustion engine may be a diesel engine as well.

In general, the lower the engine load is, the worse the heat efficiency becomes, so at the time of engine low load operation, if raising the mechanical compression ratio to raise the expansion ratio, it is possible to improve the heat efficiency due to the work time of the pistons in the expansion stroke becoming longer. The mechanical compression ratio becomes the ratio (V1+V2)/V1 of the sum of the cylinder volume V1 at the top dead center crank angle and the stroke volume V2 with respect to the cylinder volume V1 at the top dead center crank angle, and is equal to the expansion ratio of the expansion stroke. Due to this, the V-type internal combustion engine uses the first relative movement mechanism 30 and the second relative movement mechanism 40 to make the cylinder block 10 move relatively to the crankcase 20. By changing the distance between the cylinder block 10 and the crank shaft 15, the mechanical compression ratios of the first cylinder group and the second cylinder group are made variable. For example, the mechanical compression ratios are controlled so that the lower the engine load is, the higher the mechanical compression ratio is made.

Figure 2:
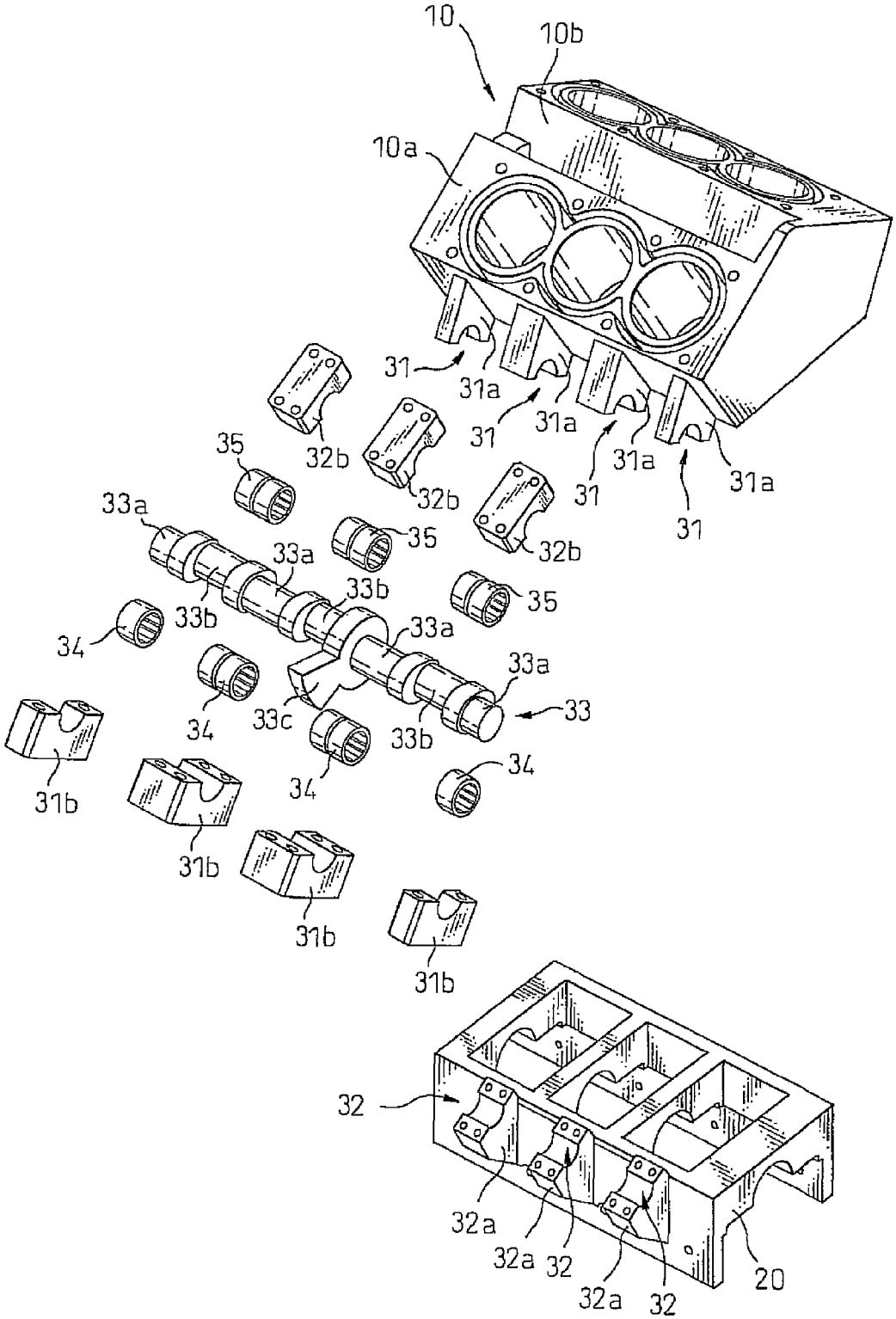
FIG. 2 is a disassembled perspective view of a first relative movement mechanism which is provided at the variable compression ratio V-type internal combustion engine of FIG. 1.

The first relative movement mechanism 30, as shown in FIG. 2, has a plurality of cylinder block side supports 31 which are fastened to the bottom part of the side surface of the first cylinder group side part 10*a* of the cylinder block 10 and a plurality of crankcase side supports 32 which are fastened to the top part of the side surface of the first cylinder group side of the crankcase 20. The cylinder block side supports 31 and crankcase side supports 32 are alternately positioned and support a single first shaft 33. In this way, the first cylinder group side part 10*a* of the cylinder block 10 and the first cylinder group side of the crankcase 20 are connected through the first relative movement mechanism 30.

The cylinder block side supports 31 and the crankcase side supports 32 are split into the two pieces 31*a* and 31*b* and 32*a* and 32*b* to enable support of the first shaft 33. The first shaft 33 has a plurality of cylinder block side support parts 33*a* which are supported by the cylinder block side supports 31 and a plurality of crankcase side support parts 33*b* which are supported by the crankcase side supports 32. The cylinder block side support parts 33*a* are concentric with each other, while the crankcase side support parts 33*b* are concentric with each other. However, the cylinder block side support parts 33*a* and the crankcase side support parts 33*b* are eccentric. Reference numeral 34 shows bearing elements which are fit at the cylinder block side support parts 33*a*, while 35 shows bearing elements which are fit at the crankcase side support parts 33*b*. These are split into two to enable fitting at the cylinder block side support parts 33*a* and crankcase side support parts 33*b*. Reference numeral 33*c* shows a fan-shaped gear which is concentric with the crankcase side support part 33*b* of the first shaft 33.

Figure 4:
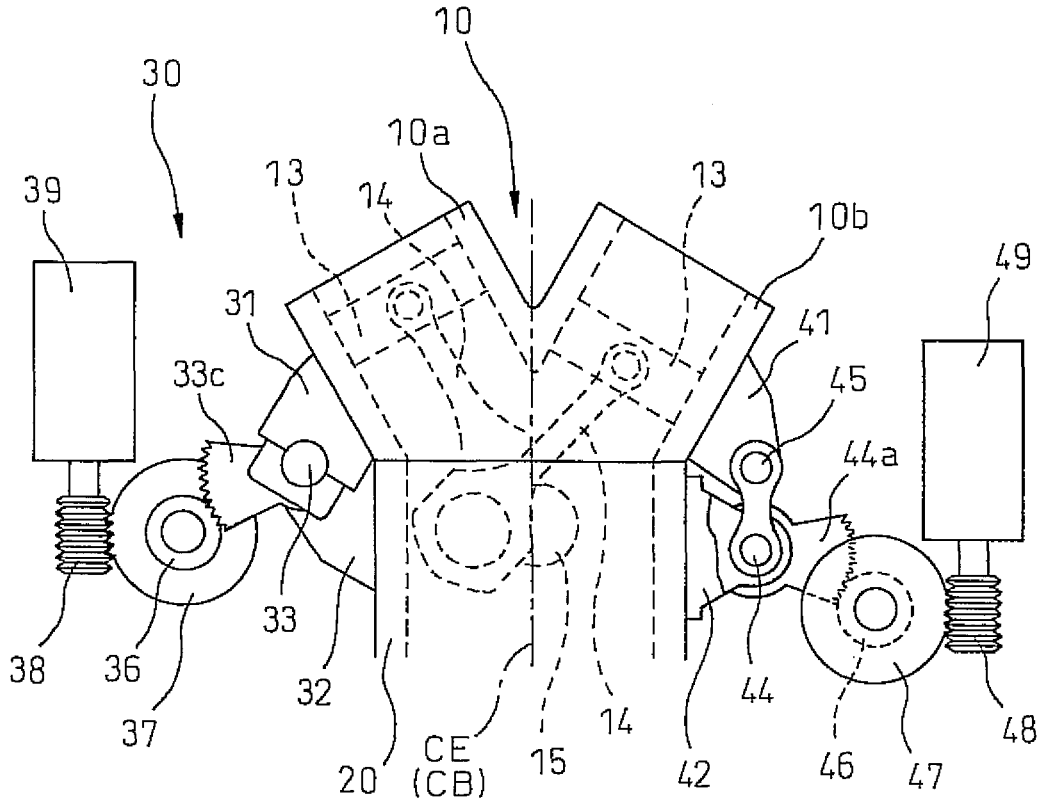
FIG. 4 is a front view showing part of a variable compression ratio V-type internal combustion engine according to the present invention.

As shown in FIG. 4, the fan-shaped gear 33*c* engages with the small diameter gear 36, while a large diameter gear 37 concentric with the small diameter gear 36 engages with a worm gear 38 of a first motor 39. By operating the first motor 39 and making the worm gear 38 rotate in this way, it is possible to make the first shaft 33 rotate about the crankcase side support part 33*b* through the large diameter gear 37, small diameter gear 36, and the fan-shaped gear 33*c*.

Figure 3:
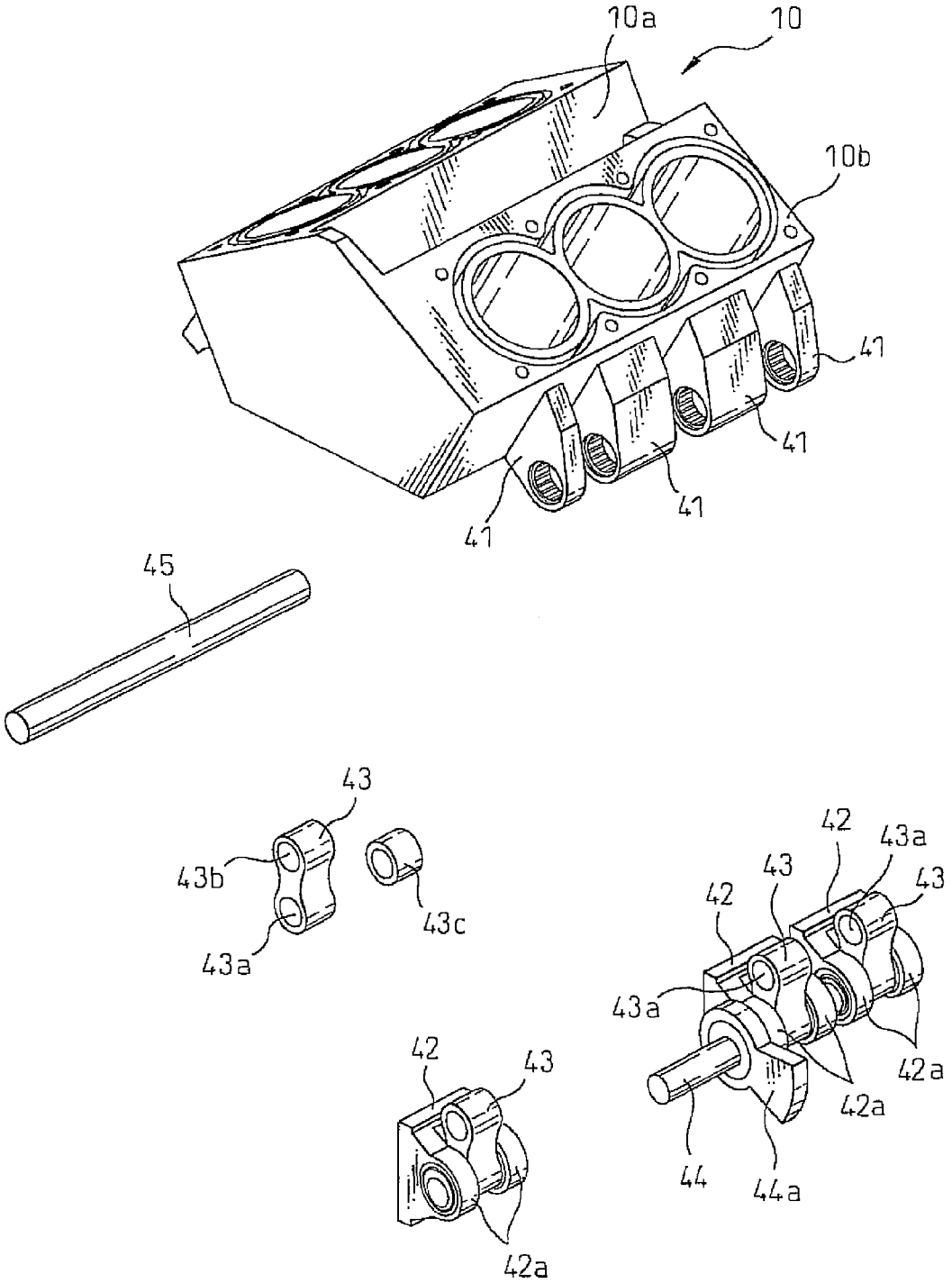
FIG. 3 is a disassembled perspective view of a second relative movement mechanism which is provided at the variable compression ratio V-type internal combustion engine of FIG. 1.

On the other hand, the second relative movement mechanism 40, as shown in FIG. 3, has a plurality of cylinder block side supports 41 which are fastened to the bottom part of the side surface of the second cylinder group side part 10*b* of the cylinder block 10 and a plurality of crankcase side supports 42 which are fastened to the top part of the side surface of the second cylinder group side of the crankcase 20. Each crankcase side support 42 has two bearings 42*a*. Between the two bearings 42*a*, an arm 43 is inserted. The arm 43 has at its ends a first through hole 43*a* and a second through hole 43*b*. Inside the first through hole 43*a*, an eccentric boss 43*c* is inserted. A second shaft 44 passes through the two bearings 42*a* of the crankcase side supports 42 and passes through the eccentric holes of the eccentric bosses 43*c* which are inserted into the first through holes 43*a* of the arms 43. Further, a third shaft 45 passes through the cylinder block side supports 41 and second through holes 43*b* of the arms 43 positioned between two cylinder block side supports 41. In this way, the second cylinder group side part 10*b* of the cylinder block 10 and the second cylinder group side of the crankcase 20 are connected through the second relative movement mechanism 40.

The bearings 42*a* of the cylinder block side supports 41 and the crankcase side supports 42 are provided with bearing elements. Reference numeral 44*a* shows a fan-shaped gear which is concentric with the second shaft 44. As shown in FIG. 4, the fan-shaped gear 44*a* engages with the small diameter gear 46, while a large diameter gear 47 which is concentric with the small diameter gear 46 engages with a worm gear 48 of the second motor 49. In this way, the second motor 49 is operated to make the worm gear 48 rotate, whereby the second shaft 44 is made to rotate through the large diameter gear 47, the small diameter gear 46, and the fan-shaped gear 44*a*. The eccentric bosses 43*c*, which are joined with the second shaft 44 by insertion into the eccentric holes, can be made to rotate about the second shaft 44 at the first through holes 43*a* of the arms 43.

Figure 5:
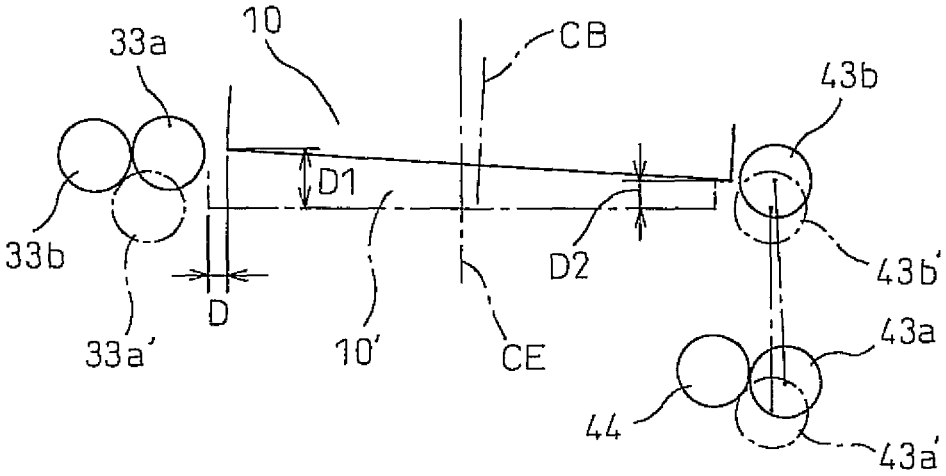
FIG. 5 is a view explaining the operations of the first relative movement mechanism and the second relative movement mechanism.

In FIG. 4, CE is the engine centerline which passes through the center of the crankshaft 15 in the front view and in general is a vertical line passing through the center of the crankshaft. In the present embodiment, at the lowest position of the cylinder block 10 which is shown in FIG. 5 where the cylinder block 10 and the crankcase 20 abut against each other, in the front view, the cylinder block centerline CB between the cylinder centerline of the first cylinder group and the cylinder centerline of the second cylinder group and the engine centerline CE match. Further, in the front view, the intersecting point of the cylinder centerline of the first cylinder group and the cylinder centerline of the second cylinder group, that is, the front view intersecting point, and the crankshaft center match.

As shown in FIG. 5, in the variable compression ratio V-type internal combustion engine of the present embodiment, to change the mechanical compression ratio, the first motor 39 of the first relative movement mechanism 30 is made to operate to make the first shaft 33 turn about the crankcase side support part 33*b*. Due to this, the first relative movement mechanism 30 acts as a link mechanism with a single degree of freedom to make the first cylinder group side of the cylinder block 10 move with respect to the crankcase 20 in the engine centerline CE direction by exactly the first set distance D1 through the cylinder block side support part 33*a* which is eccentric with respect to the crankcase side support part 33*b*. Simultaneously with this, the second motor 49 of the second relative movement mechanism 40 is made to operate to make the second shaft 44 turn. Due to this, the second relative movement mechanism 40 acts as a link mechanism with two degrees of freedom to make the second cylinder group side of the cylinder block 10 move with respect to the crankcase 20 in the engine centerline CE direction by exactly the second set distance D2 smaller than the first set distance D1 by the arm 43 through the eccentric boss 43*c* which is eccentric with respect to the second shaft 44.

In this way, the cylinder block 10' at the lowest position which is shown by the one-dot chain line moves like the cylinder block 10 which is shown by the solid line. The cylinder block side support part 33*a*' of the first shaft 33 and the first through hole 43*a*' and second through hole 43*b*' of the arm 43 at the lowest position which are shown by the one-dot chain lines also respectively move like the cylinder block side support part 33*a*, first through hole 43*a*, and second through hole 43*b* which are shown by the solid lines.

Since the first relative movement mechanism 30 is made a simple link mechanism with one degree of freedom, the cylinder block 10 is made to move with respect to the crankcase 20 upward (direction of centerline of engine CE) and simultaneously move to the second cylinder group side. With that, both the mechanical compression ratio of the first cylinder group and the mechanical compression ratio of the second cylinder group can be made smaller, but the mechanical compression ratio of the second cylinder group ends up becoming smaller than the mechanical compression ratio of the first cylinder group. Due to this, using the second relative movement mechanism 40, the cylinder block 10 is moved a bit upward at the second cylinder group side compared with the first cylinder group side. In the front view, the cylinder block centerline CB is made to slant with respect to the engine centerline CE. Due to this, even if the cylinder block 10 moves to the second cylinder group side by exactly D, the mechanical compression ratio of the first cylinder group and the mechanical compression ratio of the second cylinder group side can be equally made the desired mechanical compression ratios.

Figure 6:
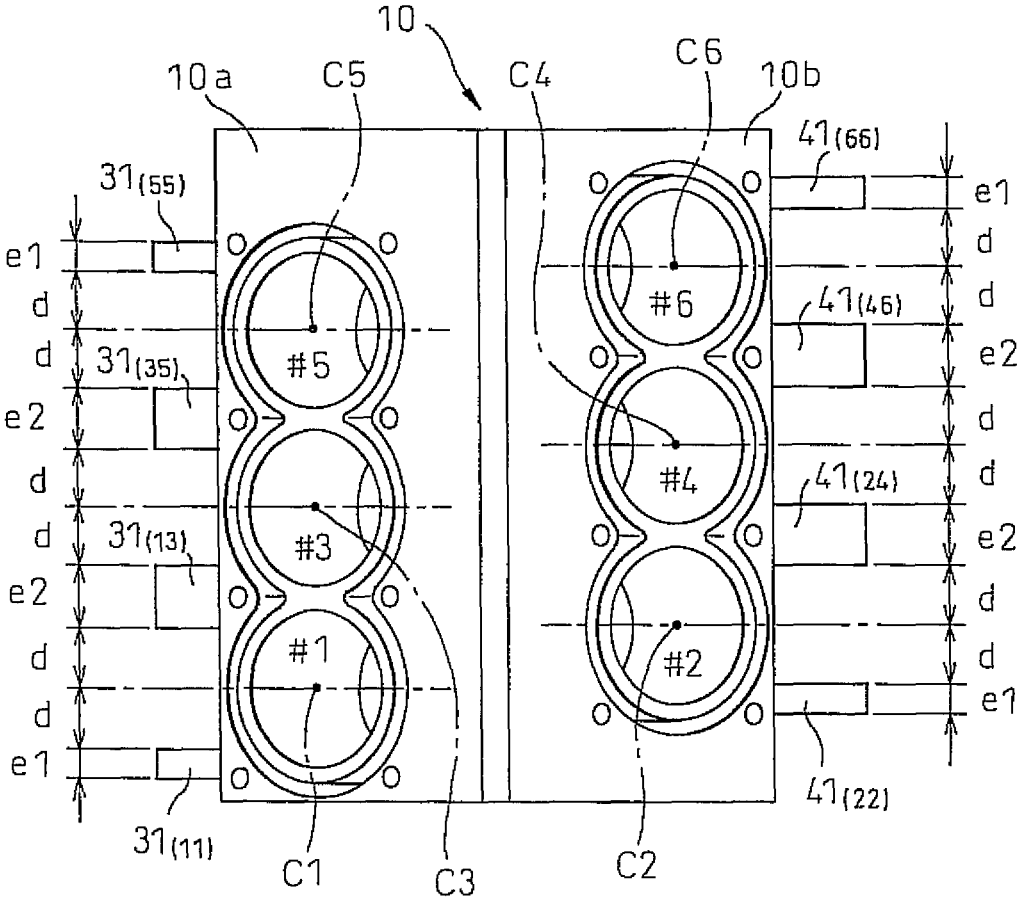
FIG. 6 is a plan view of a cylinder block of the variable compression ratio V-type internal combustion engine according to the present invention.

FIG. 6 is a plan view of a cylinder block 10 of a variable compression ratio V-type internal combustion engine according to the present invention. In the present embodiment, the number of cylinder block side supports 31 for fastening the first relative movement mechanism 30 to the first cylinder group side part 10*a* of the cylinder block 10 is made at least a number greater by exactly "1" than the number of cylinders of the first cylinder group so that one of the cylinder block side supports 31 is positioned at the two sides of the center axial lines C1, C3, and C5 at the cylinders of the first cylinder group when viewing the first cylinder group side part 10*a* by the side view, that is, in the present embodiment, since there are three cylinders in the first cylinder group, the number of cylinder block side supports 31 is made four.

Further, the number of cylinder block side supports 41 for fastening the second relative movement mechanism 40 to the second cylinder group side part 10*b* of the cylinder block 10 is made at least a number greater by exactly "1" than the number of cylinders of the second cylinder group so that one of the cylinder block side supports 41 is positioned at the two sides of the center axial lines C2, C4, and C6 at the cylinders of the second cylinder group when viewing the second cylinder group side part 10*b* by the side view, that is, in the present embodiment, since there are three cylinders in the second cylinder group, the number of cylinder block side supports 41 is made four.

Further, due to an offset between the cylinders of the first cylinder group and the cylinders of the second cylinder group in the crankshaft direction, one of the supports 31 of the first relative movement mechanism is positioned on each of the center axial lines C2, C4, and C6 of the cylinders in the second cylinder group when viewing the first cylinder group side part 10*a* by the side view (it is preferable to make centerlines of supports 31 and center axial lines of the center axial line C2, C4, and C6 of the cylinders match) and one of the supports 41 of the second relative movement mechanism is positioned on each of the center axial lines C1, C3, C5 of the cylinders in the first cylinder group when viewing the second cylinder group side part 10*a* by the side view (it is preferable to make centerlines of supports 41 and center axial lines of the center axial lines C1, C3, and C5 of the cylinders match).

Figure 7:
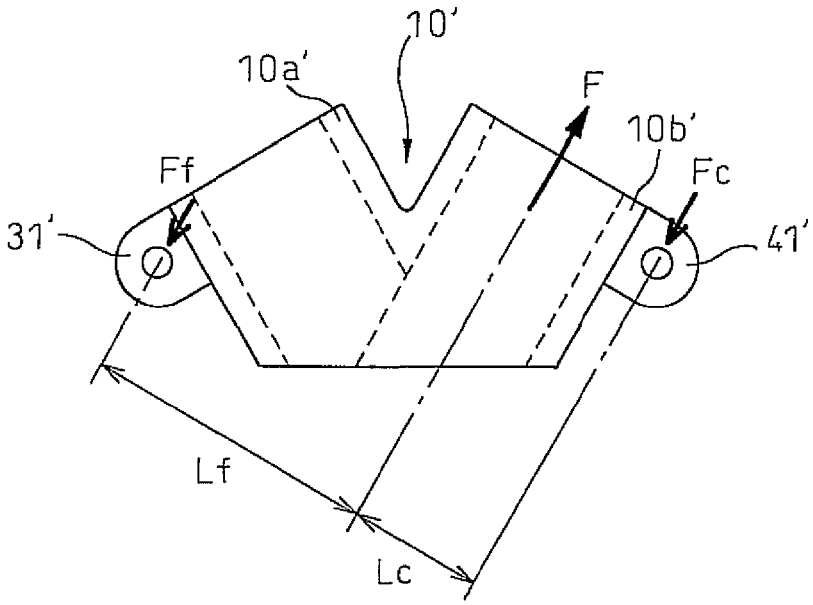
FIG. 7 is a front view of a cylinder block which shows still another embodiment of the variable compression ratio V-type internal combustion engine according to the present invention.

FIG. 7 is a front view of a cylinder block 10' which shows another embodiment of a variable compression ratio V-type internal combustion engine according to the present invention. The difference from the embodiment shown in FIGS. 4 and 6 is that the cylinder block side supports 31' of the first relative movement mechanism are arranged at the highest part of the side surface of the first cylinder group side part 10*a*' of the cylinder block 10', while the cylinder block side supports 41' of the second relative movement mechanism are arranged at the highest part of the side surface of the second cylinder group side part 10*b*' of the cylinder block 10'.

In each embodiment, at the time of firing of a cylinder, as shown in FIG. 7, a force F is produced which tries to push up the cylinder block in the center axial line direction of the firing cylinder. This force F mainly acts at the cylinder block side supports of the first relative movement mechanism and second relative movement mechanism near the firing cylinder. In the arrangement of cylinder block side supports which is shown in FIG. 6, the two cylinder block side supports which adjoin the firing cylinder when viewing the cylinder group side corresponding to the firing cylinder by the side view and the single cylinder block side support which is positioned on the center axial line of the firing cylinder when viewing the other cylinder group side by the side view are acted on. In this way, it is possible to make the force which is produced at the time of firing of each cylinder act dispersed to three cylinder block side supports, so there is no need to increase the strength of the cylinder block side supports 31 and 41 of the first relative movement mechanism and second relative movement mechanism that much. As opposed to this, in general, cylinder block side supports of the first relative movement mechanism and the second relative movement mechanism are arranged symmetrically with respect to a Median plane between the two cylinder groups, so the above-mentioned force F acts mainly against just one or two supports and it is necessary to make the strength of the cylinder block side supports very high.

For example, in FIG. 6, when the #4 cylinder of the second cylinder group which has the center axial line C4 fires, the above-mentioned force F acts against the two cylinder block side supports $\mathbf{41}_{(24)}$ and $\mathbf{41}_{(46)}$ of the second relative movement mechanism which are positioned at the two sides of the center axial line C4 of the #4 cylinder when viewing the second cylinder group side part 10*b* by the side view and against the single cylinder block side support $\mathbf{31}_{(35)}$ of the first relative movement mechanism which is positioned on the center axial line C4 of the #4 cylinder when viewing the first cylinder group side part 10*a* by the side view. Further, when the #5 cylinder of the first cylinder group which has the center axial line C5 fires, the above-mentioned force F acts against the two cylinder block side supports $\mathbf{31}_{(35)}$ and $\mathbf{31}_{(55)}$ of the first relative movement mechanism which are positioned at the two sides of the center axial line C5 of the #5 cylinder when viewing the first cylinder group side part 10*a* by the side view and against the single cylinder block side support $\mathbf{41}_{(46)}$ of the second relative movement mechanism which is positioned on the center axial line C5 of the #5 cylinder when viewing the second cylinder group side part 10*b* by the side view.

Further, the cylinder block side supports 31 of the first relative movement mechanism 30 are comprised of first supports $\mathbf{31}_{(13)}$ and $\mathbf{31}_{(35)}$ which are positioned between the center axial lines of two cylinders which adjoin each other in the first cylinder group when viewing the first cylinder group side part 10*a* by the side view and second supports $\mathbf{31}_{(11)}$ and $\mathbf{31}_{(55)}$ which are not positioned between the center axial lines of two cylinders which adjoin each other in the first cylinder group when viewing the first cylinder group side part 10*a* by the side view. The first supports $\mathbf{31}_{(13)}$ and $\mathbf{31}_{(35)}$ are close in common to two cylinders, so the force at the time of firing of the two cylinders acts on them. The force acts on them at the time of firing by a number of times two times that of the second supports $\mathbf{31}_{(11)}$ and $\mathbf{31}_{(55)}$ which are close to just single cylinders, so the thickness e2 of the first supports $\mathbf{31}_{(13)}$ and $\mathbf{31}_{(35)}$ is made two times the thickness e1 of the second supports $\mathbf{31}_{(11)}$ and $\mathbf{21}_{(55)}$ and the strength is made two times that as well.

Further, the cylinder block side supports 41 of the second relative movement mechanism 40 are comprised of third supports $\mathbf{41}_{(24)}$ and $\mathbf{41}_{(46)}$ which are positioned between the center axial lines of two cylinders which adjoin each other in the second cylinder group when viewing the second cylinder group side part 10*b* by the side view and fourth supports $\mathbf{41}_{(22)}$ and $\mathbf{41}_{(66)}$ which are not positioned between the center axial lines of two cylinders which adjoin each other in the second cylinder group when viewing the second cylinder group side part 10*b* by the side view. The third supports $\mathbf{41}_{(24)}$ and $\mathbf{41}_{(46)}$ are close in common to two cylinders, so the force at the time of firing of the two cylinders acts on them. The force acts on them at the time of firing by a number of times two times that of the fourth supports $\mathbf{41}_{(22)}$ and $\mathbf{41}_{(66)}$ which are close to just single cylinders, so the thickness e2 of the third supports $\mathbf{41}_{(24)}$ and $\mathbf{41}_{(46)}$ is made two times the thickness e1 of the fourth supports $\mathbf{41}_{(22)}$ and $\mathbf{41}_{(66)}$ and the strength is made two times that as well.

Further, the first supports $\mathbf{31}_{(12)}$ and $\mathbf{31}_{(35)}$, the second supports $\mathbf{31}_{(11)}$ and $\mathbf{31}_{(55)}$, the third supports $\mathbf{41}_{(24)}$ and $\mathbf{41}_{(46)}$, and the fourth supports $\mathbf{41}_{(22)}$ and $\mathbf{41}_{(66)}$ all are made separated by the equal distances "d" from the center axial lines C1, C2, C3, C4, C5, and C6 of the cylinders adjoining each other in the side view.

Incidentally, in the embodiment which is shown in FIG. 7, the cylinder block side supports 31' of the first relative movement mechanism are arranged at the highest part of the side surface of the first cylinder group side part 10*a'* of the cylinder block 10', while the cylinder block side supports 41' of the second relative movement mechanism are arranged at the highest part of the side surface of the second cylinder group side part 10*b'* of the cylinder block 10', so when the force F which is produced at the time of firing is divided into the force Fc which acts on the two cylinder block side supports (in FIG. 7, 41') at the cylinder group side of the firing cylinder and the force Ff which acts on the single cylinder block side support (in FIG. 7, 31') of the cylinder group side opposite to the firing cylinder, the moment length Lf up to the working point (center of axial bore) of the single cylinder block side support at the cylinder group side opposite to the firing cylinder can be made relatively longer than the moment length Lc up to the working points (centers of axial bores) of the two cylinder block side supports at the cylinder group side of the firing cylinder.

In this way, from the relationships of F=Fc+Ff and Fc*Lc=Ff*Lf, it is possible to make the force Ff which acts on the single cylinder block side support of the cylinder group opposite to the firing cylinder smaller.

Figure 8:
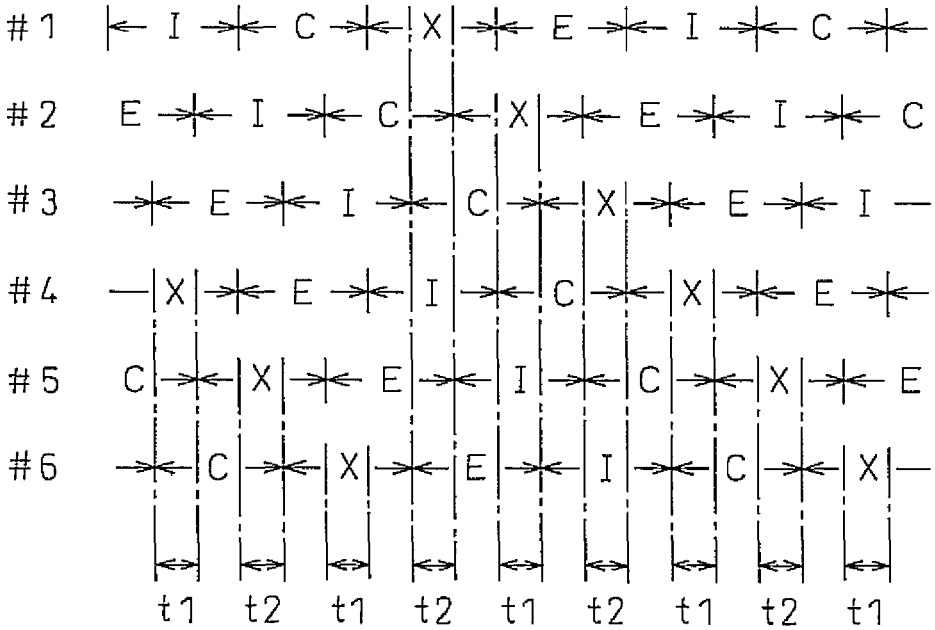
FIG. 8 is a time chart which shows the relationship between the strokes of the cylinders.

FIG. 8 is a time chart which shows the relationship of the strokes of the cylinders. "I" shows an intake stroke, "C" a compression stroke, "X an expansion stroke, and "E" an exhaust stroke. As shown in FIG. 6, the #1 cylinder, #3 cylinder, and #5 cylinder form the first cylinder group, the #2 cylinder, #4 cylinder, and #6 cylinder form the second cylinder group, and the firing sequence becomes the #1 cylinder-#2 cylinder-#3 cylinder-#4 cylinder-#5 cylinder-#6 cylinder.

As shown in FIG. 8, the cylinders of the first cylinder group and the cylinders of the second cylinder group alternately enter the expansion stroke every 120 degrees crank angle. Due to this, in the 60 degree crank angle range which is shown by t1, none of the cylinders of the first cylinder group are in the expansion stroke, while one of the cylinders of the second cylinder group is in the expansion stroke. The force of a firing cylinder of the second cylinder group acts divided to the corresponding single cylinder block side support of the first relative movement mechanism and the corresponding two cylinder block side supports of the second relative movement mechanism. At this time, the force which acts on the cylinder block side supports of the first relative movement mechanism where the moment length becomes longer than that of the cylinder block side supports of the second relative movement mechanism will not become that large. Due to this, at this time, if using the first relative movement mechanism 30 to make the first cylinder group side of the cylinder block move with respect to the crankcase in the engine centerline CE direction by exactly the first set distance, it is possible to make the first relative movement mechanism operate by a small working force.

Further, in the range of 60 degrees crank angle which is shown by t2, none of the cylinders of the second cylinder group is in the expansion stroke, while one of the cylinders of the first cylinder group is in the expansion stroke, so the force of a firing cylinder of the first cylinder group acts divided to the corresponding single cylinder block side support of the second relative movement mechanism and the corresponding two cylinder block side supports of the first relative movement mechanism. At this time, the force which acts on the cylinder block side support of the second relative movement mechanism where the moment length becomes longer than that of the cylinder block side supports of the first relative movement mechanism will not become that large. Due to this, at this time, if using the second relative movement mechanism 40 to make the second cylinder group side of the cylinder block move with respect to the crankcase in the engine centerline CE direction by exactly the second set distance, it is possible to make the second relative movement mechanism operate by a small working force.

Of course, it is also possible to make the first relative movement mechanism operate slightly in the crank angle range which is shown by t1, make the second relative movement mechanism operate slightly in the crank angle range which is shown by t2, and repeat these so as to finally make the first cylinder group side of the cylinder block move by exactly the first set distance, make the second cylinder group side of the cylinder block move by exactly the second set distance, and thereby make mechanical compression ratios of the first cylinder group and the second cylinder group the desired mechanical compression ratios.

In the embodiments which were explained up to here, the first relative movement mechanism and the second relative movement mechanism were made separately controllable and the first relative movement distance in the engine centerline direction of the first cylinder group side of the cylinder block and the second relative movement distance in the engine centerline direction of the second cylinder group side of the cylinder block were able to be made different, but when the cylinder block centerline CB and the engine centerline CE always match and the cylinder block moves relatively to the crankcase, the first relative movement mechanism and the second relative movement mechanism may also be made to simultaneously operate by a single actuator. In this case as well, the arrangement of the cylinder block side supports of the first relative movement mechanism and second relative movement mechanism which is shown in FIG. 6 is effective.

LIST OF REFERENCE NUMERALS

10: cylinder block
20: crankcase
30: first relative movement mechanism
31: cylinder block side support of first relative movement mechanism
40: second relative movement mechanism
41: cylinder block side support of second relative movement mechanism

The invention claimed is:

1. A variable compression ratio V-type internal combustion engine which joins cylinder blocks of two cylinder groups and makes the joined cylinder block move relatively to a crankcase, the engine comprising:

a first relative movement mechanism which is fastened to a first cylinder group side of said joined cylinder block through a plurality of supports, which are fastened to the cylinder block; and a second relative movement mechanism which is fastened to a second cylinder group side of said joined cylinder block through a plurality of supports, which are fastened to the cylinder block, wherein the number of said supports of said first relative movement mechanism is made at least a number greater by exactly one than the number of cylinders of said first cylinder group so that one of said supports of said first relative movement mechanism is positioned at the two sides of center axial lines of the cylinders in said first cylinder group when viewing said first cylinder group side by the side view, the number of said supports of said second relative movement mechanism is made at least a number greater by exactly one than the number of cylinders of said second cylinder group so that one of said supports of said second relative movement mechanism is positioned at the two sides of center axial lines of the cylinders in said second cylinder group when viewing said second cylinder group side by the side view, wherein due to an offset between the cylinders of said first cylinder group and the cylinders of said second cylinder group in a crankshaft direction, one of said supports of said first relative movement mechanism is positioned on the center axial line of each cylinder in said second cylinder group when viewing said first cylinder group side by the side view and one of said supports of said second relative movement mechanism is positioned on the center axial line of each cylinder in said first cylinder group when viewing said second cylinder group side by the side view, wherein a force acting to push up the cylinder block, in the cylinder axial line direction, at a time of firing of each cylinder, is dispersed to the two supports of the cylinder group side corresponding to the firing cylinder and the one support of the cylinder group side opposing the firing cylinder, and wherein said first relative movement mechanism and said second relative movement mechanism are made independently controllable, a first relative movement distance in a front view engine centerline direction which passes through a center of a crankshaft which is caused by said first relative movement mechanism at said first cylinder group side of said joined cylinder block and a second relative movement distance which is caused by said second relative movement mechanism at said second cylinder group side of said joined cylinder block can be made different.

2. The variable compression ratio V-type internal combustion engine according to claim 1, wherein said supports of said first relative movement mechanism are comprised of first supports which are positioned between center axial lines of two cylinders adjoining each other in said first cylinder group when viewing said first cylinder group side by the side view and second supports which are not positioned between center axial lines of two cylinders adjoining each other in said first cylinder group when viewing said first cylinder group side by the side view, a thickness of said first supports is two times a thickness of said second supports, said supports of said second relative movement mechanism are comprised of third supports which are positioned between center axial lines of two cylinders adjoining each other in said second cylinder group when viewing said second cylinder group side by the side view and fourth supports which are not positioned between center axial lines of two cylinders adjoining each other in said second cylinder group when viewing said second cylinder group side by the side view, and a thickness of said third supports is two times a thickness of said fourth supports.

3. The variable compression ratio V-type internal combustion engine according to claim 1, wherein said first relative movement mechanism changes said first relative movement distance when none of the cylinders of said first cylinder group is in an expansion stroke, and said second relative movement mechanism changes said second relative movement distance when none of the cylinders of said second cylinder group is in an expansion stroke.

4. The variable compression ratio V-type internal combustion engine according to claim 2, wherein said first relative movement mechanism changes said first relative movement distance when none of the cylinders of said first cylinder group is in an expansion stroke, and said second relative movement mechanism changes said second relative movement distance when none of the cylinders of said second cylinder group is in an expansion stroke.

* * * * *